US010141680B2

(12) United States Patent
Kitagawa

(10) Patent No.: US 10,141,680 B2
(45) Date of Patent: Nov. 27, 2018

(54) WATERPROOF CONNECTOR

(71) Applicant: Sumitomo Wiring Systems, Ltd., Yokkaichi, Mie (JP)

(72) Inventor: Yuji Kitagawa, Mie (JP)

(73) Assignee: SUMITOMO WIRING SYSTEMS, LTD., Yokkaichi, Mie (JP)

( * ) Notice: Subject to any disclaimer, the term of this patent is extended or adjusted under 35 U.S.C. 154(b) by 0 days.

(21) Appl. No.: 15/805,185

(22) Filed: Nov. 7, 2017

(65) Prior Publication Data

US 2018/0151976 A1 May 31, 2018

(30) Foreign Application Priority Data

Nov. 25, 2016 (JP) ..... 2016-228701

(51) Int. Cl.
*H01R 13/52* (2006.01)

(52) U.S. Cl.
CPC ..... *H01R 13/521* (2013.01)

(58) Field of Classification Search
CPC ..... H01R 13/5202; H01R 13/521
See application file for complete search history.

(56) References Cited

U.S. PATENT DOCUMENTS

2007/0099501 A1 5/2007 Tsuchiya et al.

*Primary Examiner* — Briggitte R Hammond
(74) *Attorney, Agent, or Firm* — Gerald E. Hespos; Michael J. Porco; Matthew T. Hespos

(57) ABSTRACT

Seals 40 are disposed in a rear part of a connector housing 10, and rearward detachment of the seals 40 is restricted by rear holders 50. A terminal fitting 80 is inserted into a cavity 15 of the connector housing 10 from a through hole 57 of the rear holder 50 via a seal hole 41 of the seal member 40. The through hole 57 of the rear holder 50 is provided with a guiding surface 59 inclined toward a center of the seal hole 41 with respect to a front-rear direction toward front in a range extending substantially over the entire length of the through hole 57 in the front-rear direction with the rear holder 50 disposed on the connector housing 10.

7 Claims, 13 Drawing Sheets

WATERPROOF CONNECTOR

BACKGROUND

Field of the Invention

The invention relates to a waterproof connector.

Description of the Related Art

U.S. Patent Application Pub. No. 2007/0099501 discloses a waterproof connector with a housing body having terminal insertion openings, terminals with wire to be inserted into the terminal insertion openings, a one-piece rubber plug having wire insertion holes and a rear holder having guiding tubes. The one-piece rubber plug is accommodated into a plug accommodating portion in a rear part of the housing body and is held by the rear holder to restrict rearward detachment. The terminal is inserted into the terminal insertion opening from the guiding tube via the wire insertion hole and includes a tab on a tip. A taper is provided on one circumferential part near the rear entrance of the guiding tube. The taper is intended to guide the tab of the terminal into the guiding tube so that the tip of the tab will not will not damage the inner surface of the wire insertion hole, for example by contacting the side surface of seal lip.

However, the taper is provided on only one circumferential part of the rear entrance of the guiding tube. Thus, the tab of the terminal may not slide on the tapered part at the entrance of the guiding tube and may be inserted into the guiding tube without being guided by the taper. A terminal that is inserted into the guiding tube without being guided by the taper may damage the one-piece rubber plug, and a damaged one-piece rubber plug may not ensure predetermined waterproofness. Damage of the one-piece rubber plug is particularly notable when a center of the tab of the terminal does not coincide with a center of a box portion and is eccentric.

The invention was completed based on the above situation and aims to provide a waterproof connector capable of reliably ensuring waterproofness.

SUMMARY

The invention is directed to a waterproof connector with a connector housing including a cavity extending in a front-rear direction. A seal is disposed in a rear part of the connector housing and includes a seal hole communicating with the cavity in the front-rear direction. A rear holder is disposed on the connector housing to restrict rearward detachment of the seal and includes a through hole communicating with the seal hole in the front-rear direction. A terminal fitting is inserted into the cavity from the through hole via the seal hole and a wire connected to the terminal fitting is inserted into the seal hole to provide sealing around the wire. The through hole is provided with a guiding surface inclined toward a center of the seal hole with respect to the front-rear direction toward front in a range extending substantially over the entire length of the through hole in the front-rear direction with the rear holder disposed on the connector housing.

The tip of the terminal fitting moves toward the center of the seal hole by inserting the terminal fitting into the through hole along the guiding surface so that the tip of the terminal fitting can be inserted smoothly into the seal hole. The guiding surface is provided in the range extending substantially over the entire length of the through hole in the front-rear direction. Thus, the terminal fitting can be guided reliably into the seal hole. As a result, the damage of the seal can be prevented more reliably and predetermined waterproofness can be reliably ensured.

The guiding surface may constitute two sides parallel to each other in a lengthwise cross-sectional shape of the through hole. According to this configuration, the terminal fitting is inserted with rattling suppressed to be small between the two sides of the guiding surface. Thus, the accuracy of a guiding operation of the guiding surface can be enhanced.

The guiding surface may be arranged obliquely by disposing an axial center of the rear holder obliquely in a direction intersecting the front-rear direction with respect to the connector housing. According to this configuration, in forming the guiding surface need not be inclined with respect to an axial center direction of the rear holder and the rear holder is easier to manufacture.

A rib extending in the front-rear direction may be provided on an outer surface of the rear holder and may be formed to increase a projecting amount from the outer surface of the rear holder toward the rear. A projecting end surface of the rib may contact a facing part along the front-rear direction. Thus, the rear holder is disposed in an inclined state on the connector housing. According to this configuration, inclining the rear holder with respect to the connector housing merely requires a change to the projecting amount of the rib. Thus, the structure of the rear holder does not become particularly complicated.

Plural rear holders may be disposed on the connector housing. The rear holders adjacent to each other may be disposed such that the outer surfaces provided with the ribs face each other. The projecting end surface of the rib provided on the outer surface of a first rear holder may contact the outer surface of a second rear holder along the front-rear direction, and the projecting end surface of the rib provided on the outer surface of the second rear holder may come into contact with the outer surface of the first rear holder along the front-rear direction. In this way, the respective adjacent rear holders act with each other via the ribs with respect to the connector housing so that the rear holders can be inclined with respect to the connector housing. Thus, no special structure other than the ribs is necessary and the structure can be simplified. Further, the respective rear holders can be identical to each other so that fewer types of components are needed.

DETAILED DESCRIPTION

Figure 1:
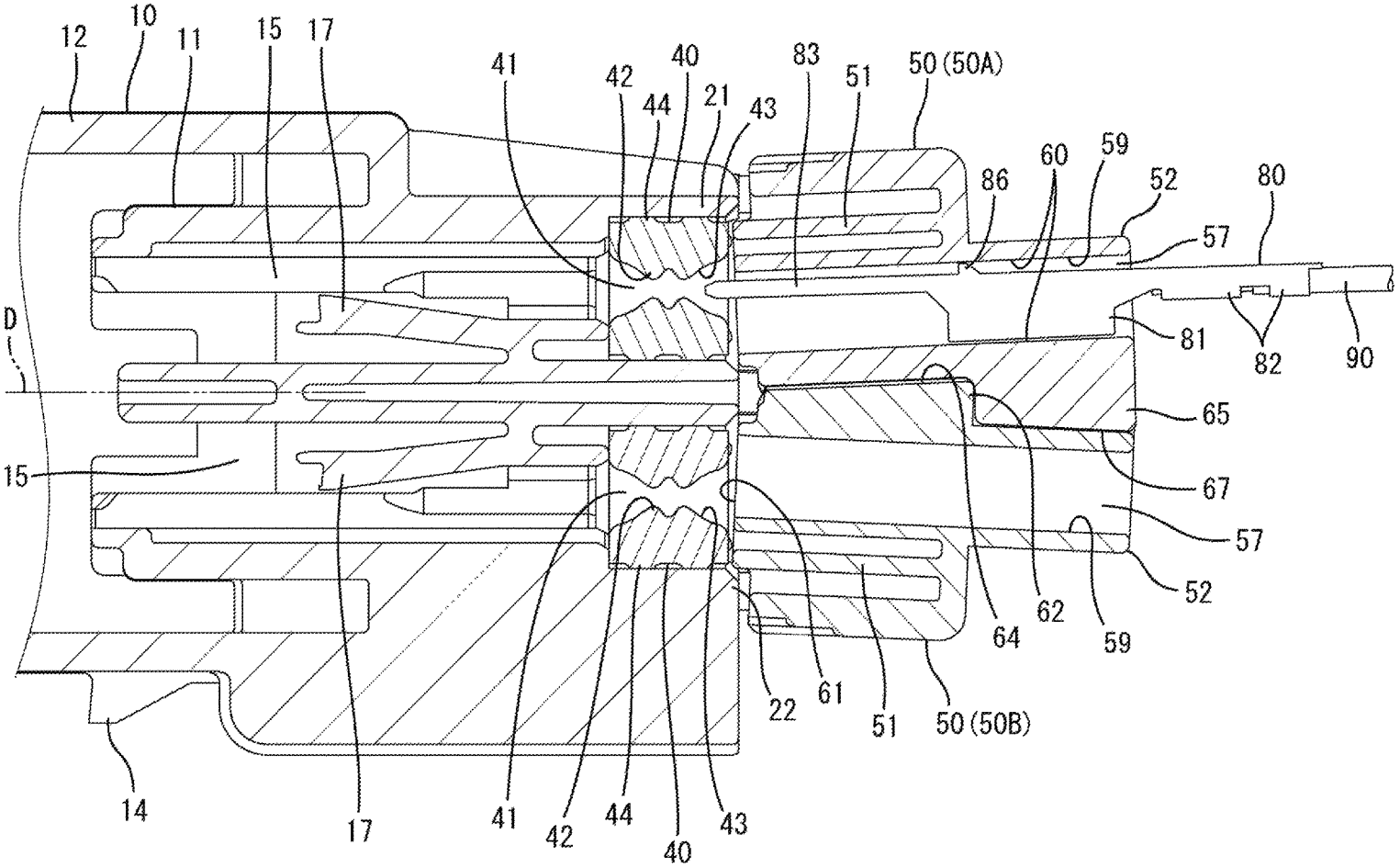
FIG. 1 is a section showing a state where a terminal fitting is inserted into a through hole of a rear holder in a waterproof connector of a first embodiment of the present invention.

A first embodiment of the present invention is described with reference to FIGS. 1 to 11. A waterproof connector of the first embodiment includes, as shown in FIG. 1, a connector housing 10, seal members 40 disposed in the connector housing 10, rear holders 50 disposed on the connector housing 10 for restricting the detachment of the seal members 40 from the connector housing 10, and terminal fittings 80 to be accommodated into the connector housing 10. The connector housing 10 is connectable to an unillustrated mating connector housing. Note that, in the following description, a surface side of the connector housing 10 facing the mating connector housing when connection is started (right side of FIGS. 1 and 2) is referred to as a front side concerning a front-rear direction, and a vertical direction is based on each figure except FIG. 11.

Figure 5:
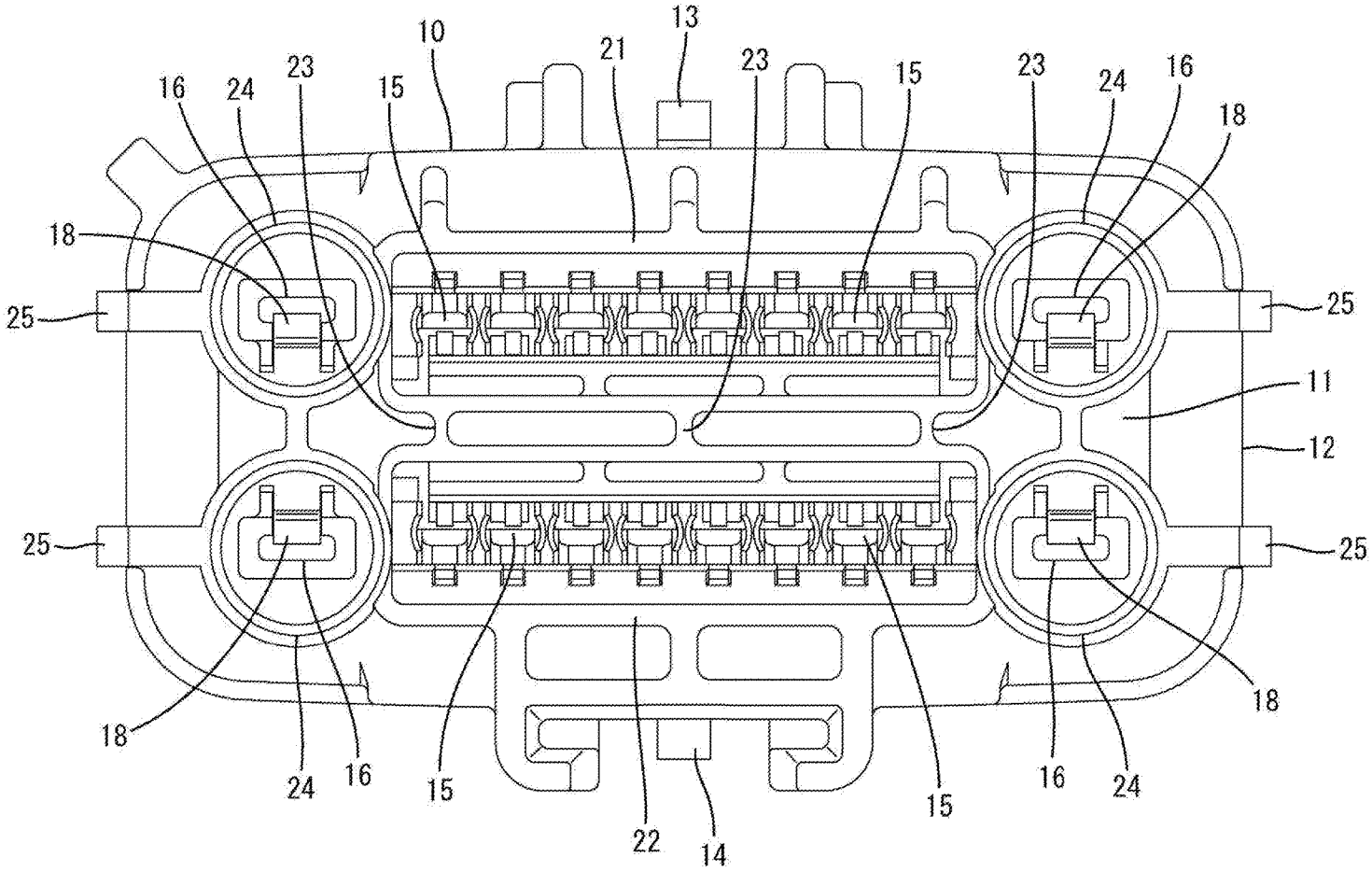
FIG. 5 is a back view of the connector housing.
Figure 6:
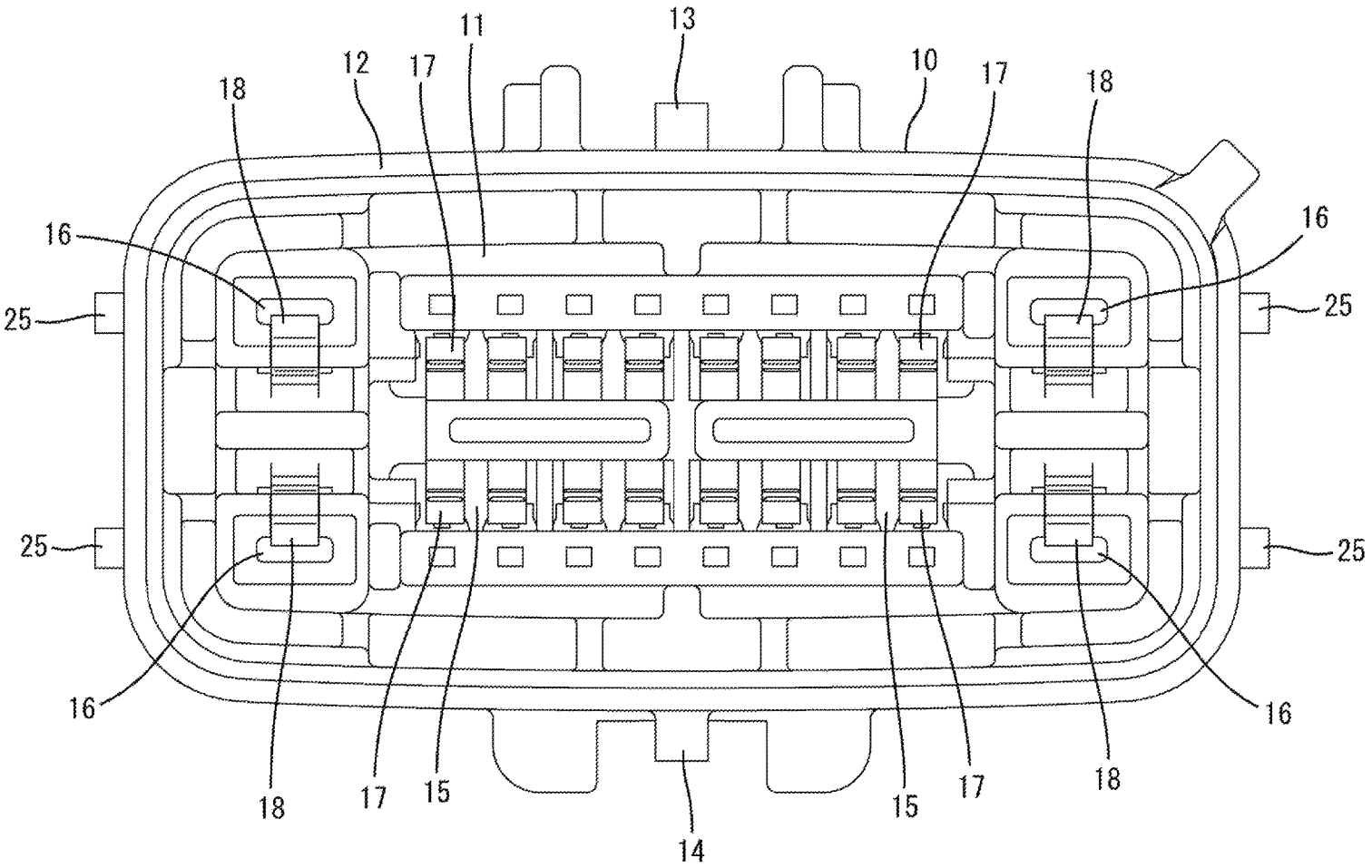
FIG. 6 is a front view of the connector housing.

The connector housing 10 is made of synthetic resin and includes, as shown in FIGS. 5 and 6, a housing body 11 substantially in the form of a rectangular block shaped to be long and flat in a lateral direction as a whole and a receptacle 12 substantially in the form of a rectangular tube projecting forward from the outer periphery of the housing body 11.

A housing lock portion 13 for holding the mating connector housing in a connected state projects on the upper surface of the receptacle 12. A mounting portion 14 on which an unillustrated bracket is to be mounted projects on the lower surface of the receptacle 12.

A plurality of cavities 15 into which the terminal fittings 80 are insertable from behind are provided in the housing body 11. The respective cavities 15 extend in the front-rear direction and penetrate through the housing body 11, and a plurality of cavities 15 are aligned and arranged in the lateral direction in each of two upper and lower stages. Further, the housing body 11 is provided with large cavities 16 having a larger diameter than the respective cavities 15 on both left and right sides across the respective cavities 15 in the two upper and lower stages.

As shown in FIG. 1, a locking lance 17 cantilevered forward is provided at the inner surface of each cavity 15. The respective locking lances 17 are provided to project back-to-back in a separation wall part partitioning between the respective cavities 15 in the two upper and lower stages. The terminal fitting 80 inserted into each cavity 15 is resiliently locked, retained and held by the locking lance 17.

The terminal fitting 80 is integrally formed such as by bending a conductive metal plate, and long and narrow in the front-rear direction as a whole as shown in FIG. 1. This terminal fitting 80 is of a male type and includes a tubular box portion 81 having a substantially rectangular cross-section, a barrel portion 82 in the form of an open barrel connected behind the box portion 81 and a tab 83 projecting forward from the front end of the box portion 81. The barrel portion 82 is electrically and mechanically connected to an end part of a wire 90 by crimping.

The tab 83 contacts an unillustrated mating terminal fitting accommodated in the mating connector housing to be electrically connected when the connector housing 10 is connected to the mating connector housing. Specifically, the tab 83 projects forward without any step from the upper surface of the box portion 81, and an axial center thereof is deviated from that of the box portion 81 when the terminal fitting 80 is viewed from front. Further, an unillustrated large-size terminal fitting is inserted into the large cavity 16, and the large-size terminal fitting is retained and held by a large locking lance 18 provided to project at the inner surface of the large cavity 16.

As shown in FIGS. 1 and 5, an upper accommodating portion 21 in the form of a laterally long tube projecting rearward from a location corresponding to the respective cavities 15 in the upper stage and a lower accommodating portion 22 in the form of a laterally long tube projecting rearward from a location corresponding to the respective cavities 15 in the lower stage are provided in a rear part of the housing body 11. The upper and lower accommodating portions 21, 22 are respectively open in the rear surface of the housing body 11 while having the same opening area.

Figure 4:
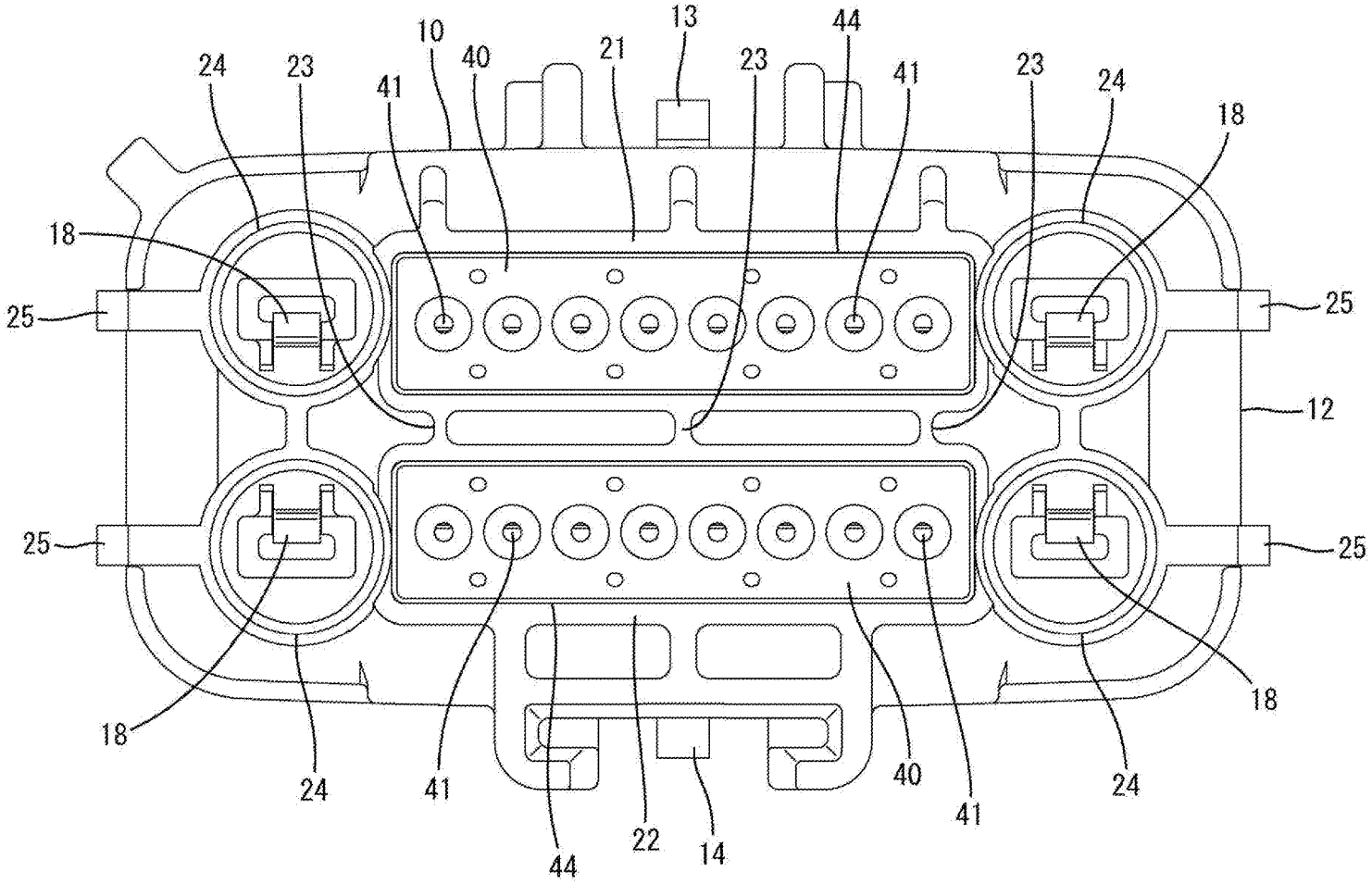
FIG. 4 is a back view of a connector housing in which seal members are accommodated in accommodating portions.

The rear ends of the respective cavities 15 in the upper stage are open in the back surface of the upper accommodating portion 21, and the rear ends of the respective cavities 15 in the lower stage are open in the back surface of the lower accommodating portion 22. A lower wall part of the upper accommodating portion 21 and an upper wall part of the lower accommodating portion 22 are coupled via a plurality of intermediate ribs 23 spaced apart in the lateral direction. As shown in FIG. 4, the seal members 40 are respectively inserted into the upper and lower accommodating portions 21, 22 from behind. The seal member 40 can be accommodated into either one of the upper and lower accommodating portions 21, 22. Note that, in the following description, the upper and lower accommodating portions 21, 22 are merely called accommodating portions 21, 22 unless it is necessary to distinguish them.

Rubber plug accommodating portions 24 having a cylindrical shape are provided to project rearward at locations corresponding to the respective large cavities 16. Each rubber plug accommodating portion 24 is coupled to a left or right side wall part of the corresponding accommodating portion 21, 22 and includes a part projecting further rearward than the rear ends of the accommodating portions 21, 22. An unillustrated individual rubber plug connected to the large-size terminal fitting is inserted into each rubber plug accommodating portion 24 from behind.

A plurality of lock projections 25 are provided on both side surfaces of a rear part of the housing body 11. Each lock projection 25 projects laterally outwardly of the rubber plug accommodating portion 24, and a pair of lock projections 25 are provided on both upper and lower sides of each of the both side surfaces of the rear part of the housing body 11.

Figure 7:
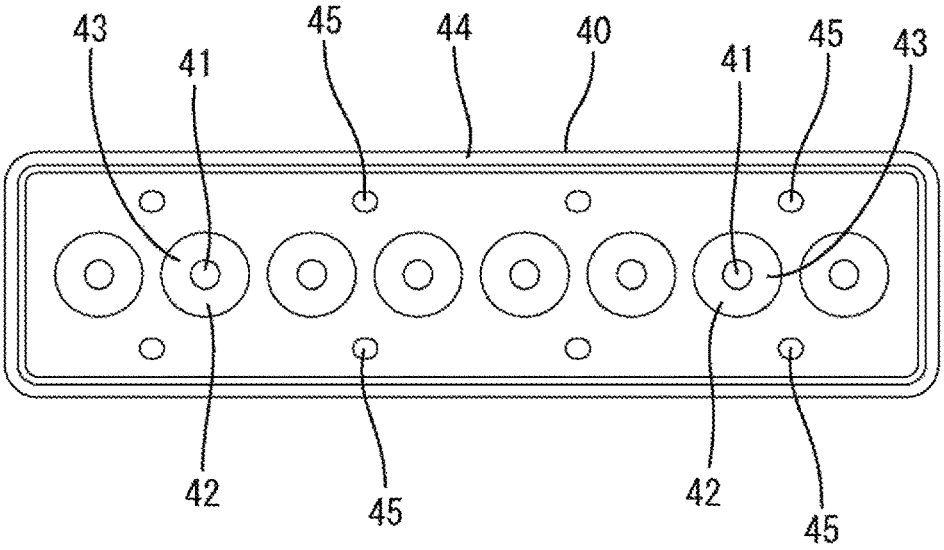
FIG. 7 is a front view of the seal member.

The seal member 40 is made of rubber such as silicon rubber, in the form of a rectangular mat long in the lateral direction and shaped to be symmetrical in the vertical direction, lateral direction and front-rear direction as shown in FIG. 7. Thus, insertion orientations of the seal members 40 into the accommodating portions 21, 22 need not be distinguished, which ensures assembling facility.

A plurality of seal holes 41 are provided side by side at intervals in the lateral direction in the seal member 40. Each seal hole 41 penetrates through the seal member 40 in the front-rear direction, has a circular cross-section and is, as shown in FIG. 1, arranged to communicate with the corresponding cavity 15 in the front-rear direction with the seal member 40 accommodated in the accommodating portion 21, 22.

A plurality of (two in a shown example) inner peripheral lips 44 are circumferentially provided at intervals in the front-rear direction on the inner peripheral surface of the seal hole 41. A tapered slope 43 reduced in diameter toward an axial center of the seal member 41 from an opening end (front end opening or rear end opening) of the seal member 40 is provided on the peripheral surface of each inner peripheral lip 42.

Further, a plurality of (two in a shown example) outer peripheral lips 44 are circumferentially provided at intervals in the front-rear direction on the outer peripheral surface of the seal hole 41. When the seal member 40 is accommodated into the accommodating portion 21, 22, each outer peripheral lip 44 is resiliently held in close contact with the inner peripheral surface of the accommodating portion 21, 22. Further, as shown in FIG. 7, a plurality of projections 45 are provided at intervals in the lateral direction on both upper and lower sides across the respective seal holes 41 on both front and rear surfaces of the seal member 40. Each projection 45 can be resiliently held in close contact with the back surface of the accommodating portion 21, 22 on a front surface side of the seal member 40.

A pair of the rear holders 50 are made of synthetic resin, shaped to be long and narrow in the lateral direction as a whole, and mounted at positions corresponding to the upper and lower accommodating portions 21, 22 with respect to the connector housing 10 as shown in FIG. 1. This pair of upper and lower rear holders 50 are identical to each other and commonly used also for the unillustrated female mating connector housing. Thus, it is sufficient to prepare one type of the rear holders 50 for the entire connector.

The pair of upper and lower rear holders 50 are vertically point-symmetrically arranged via an axis of symmetry S (see FIG. 3) in a center of the connector in a height direction. Note that although the upper rear holder (identical to the lower rear holder, but referred to as the upper rear holder 50A below to distinguish the arrangement) is described in the following description of the structure of the rear holders 50, an upper/lower concept of the upper rear holder 50A may be reversed for the lower rear holder (similarly, referred to as the lower rear holder 50B below). Thus, an upper side in the upper rear holder 50A means a lower side in the lower rear holder 50B and an outer side distant from the axis of symmetry S in the height direction of the entire connector, and a lower side in the upper rear holder 50A means an upper side in the lower rear holder 50B and an inner side close to the axis of symmetry S in the height direction of the entire connector.

Specifically, the rear holder 50 (upper rear holder 50A) is composed of a holder body 51 long in the lateral direction and a projecting portion 52 projecting rearward from a laterally central part of the rear surface of the holder body 51 as shown in FIGS. 8 to 11. The holder body 51 is arranged to cover an upper part of the housing body 11 from the upper accommodating portion 21 to the rubber plug accommodating portions 24 at both sides of the upper accommodating portion 21. Fitting portions 53 which have an arcuate cross-section and into which the rubber plug accommodating portions 24 are fittable are provided on both left and right sides of the holder body 51. A rear opening of the fitting portion 53 is partially closed by a cross-shaped closing rib 54. The closing rib 54 functions to restrict rearward detachment of the individual rubber plug accommodated in the rubber plug accommodating portion 24.

Figure 2:
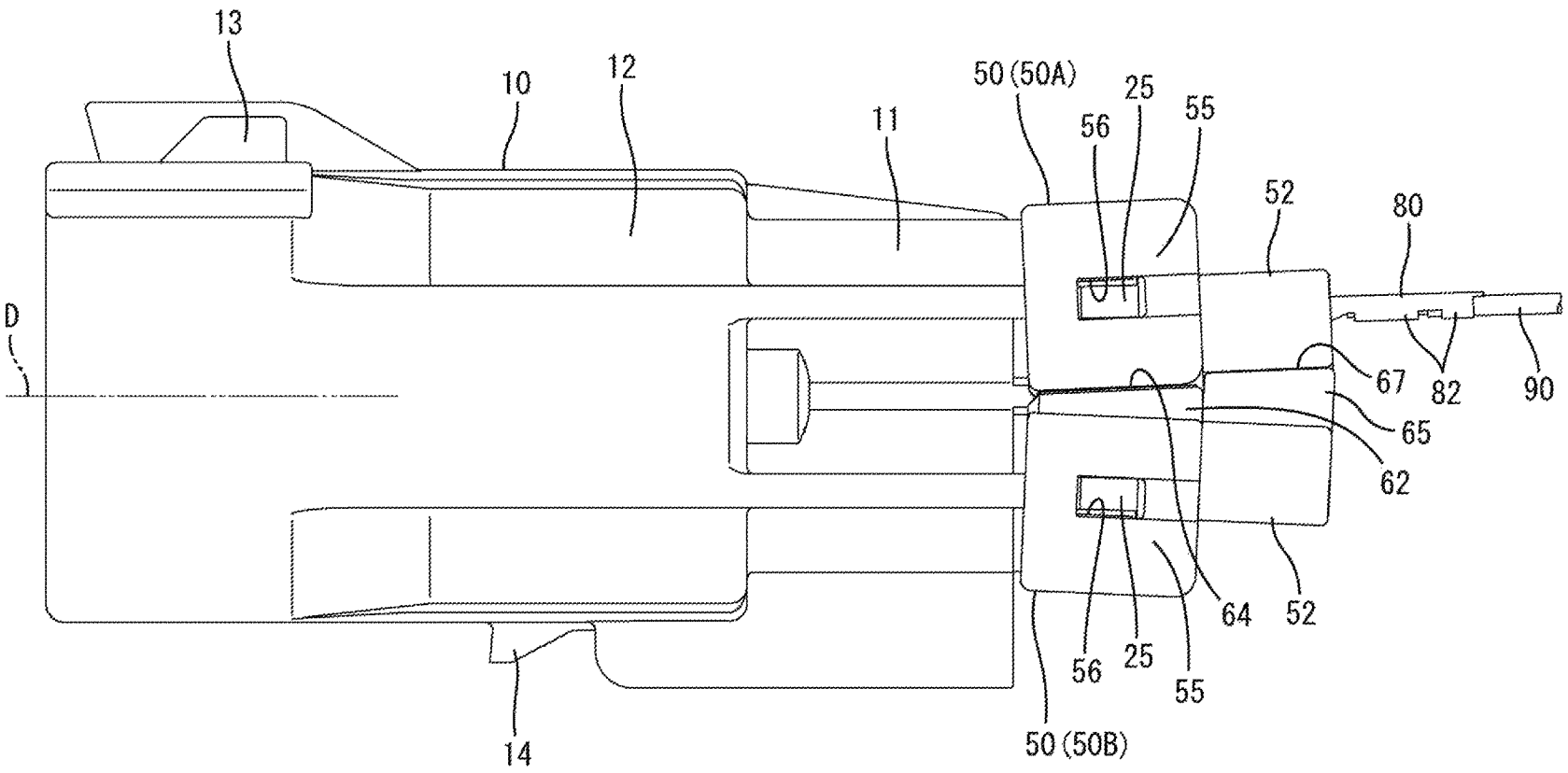
FIG. 2 is a side view corresponding to FIG. 1.

Lock portions 55 in the form of curved pieces for closing both left and right sides of the fitting portions 53 are deflectably and deformably provided on both left and right end parts of the holder body 51. A lock hole 56 is provided to penetrate through the lock portion 55 in the lateral direction. As shown in FIG. 2, the corresponding lock projections 25 of the housing body 11 are resiliently fit into the lock holes 56 of the respective lock portions 55, whereby the respective lock portions 55 are locked to the lock projections 25 and the rear holder 50 is held on the connector housing 10.

A plurality of through holes 57 are provided at intervals in the lateral direction at positions between the both fitting portions 53 in a laterally central part of the holder body 51. Each through hole 57 has a substantially rectangular cross-sectional shape corresponding to a cross-sectional shape of the box portion 81 of the terminal fitting 80 and penetrates from the holder body 51 to the projecting portion 52. A penetrating direction of the through hole 57 is the same as an axial center direction of the entire rear holder 50 and set to be parallel to the outer peripheral surface of the holder body 51. When the rear holder 50 is mounted on the connector housing 10, each through hole 57 communicates with the corresponding seal hole 41 in the front-rear direction.

Each through hole 57 is continuous substantially over the entire length while having the same cross-sectional shape and the same dimensions (except at tapered guiding parts open in the rear surface of the projecting portion 52). A hole edge of the through hole 57 includes a recess 58 into which a stabilizer 86 formed on the box portion 81 of the terminal fitting 80 is fit. By fitting the stabilizer 86 into the recess 58, an inserting operation of the terminal fitting 80 into the through hole 57 is guided to restrict the insertion of the terminal fitting 80 in a posture different from the proper one into the through hole 57.

The inner surfaces of the through holes 57 correspond to the cross-sectional shape of the through holes 57 described above and are, as shown in FIG. 1, inclined with respect to the front-rear direction, which is an axial center direction of the connector housing 10, when the respective upper and lower rear holders 50A, 50B are mounted on the connector housing 10. Specifically, the rear holder 50A is gently inclined downwardly toward the front and oriented toward a central side of the seal hole 41. Thus, the entire inner surface of the through hole 57 functions as a guiding surface 59 for guiding the terminal fitting 80 toward the central side of the seal hole 41. Since this guiding surface 59 has constant dimensions substantially over the entire length of the through hole 57, the guiding surface 59 is defined by two sides 60 parallel to each other in a lengthwise cross-sectional shape as shown in FIG. 1 when the through hole 57 is laterally viewed. The box portion 81 of the terminal fitting 80 is inserted and guided substantially over the entire length of the through hole 57 with circumferential loose movements suppressed to be small between the two sides 60 of the guiding surface 59.

A detachment restricting surface 61 in which the front ends of the respective through holes 57 are open is provided in a laterally central part of the front surface of the holder body 51. The detachment restricting surface 61 slightly projects from the surrounding on the front surface of the holder body 51, is arranged to be flat in the vertical and lateral directions, and functions to restrict rearward detachment of the seal member 40 by contactably facing the rear surface of the seal member 40 when the rear holder 50 is mounted on the connector housing 10.

The projecting portion 52 has a laterally long flat cross-sectional shape to collectively surround the respective through holes 57, and projects at a position between the both fitting portions 53 of the holder body 51 and on a lower part of the laterally central part of the rear surface of the holder body 51. Each through hole 57 penetrates through the holder body 51 and the projecting portion 52, thereby having a length equal to or longer than a length of the terminal fitting 80 from the front end of the tab 83 to the rear end of the box portion 81 as shown in FIG. 1.

Figure 8:
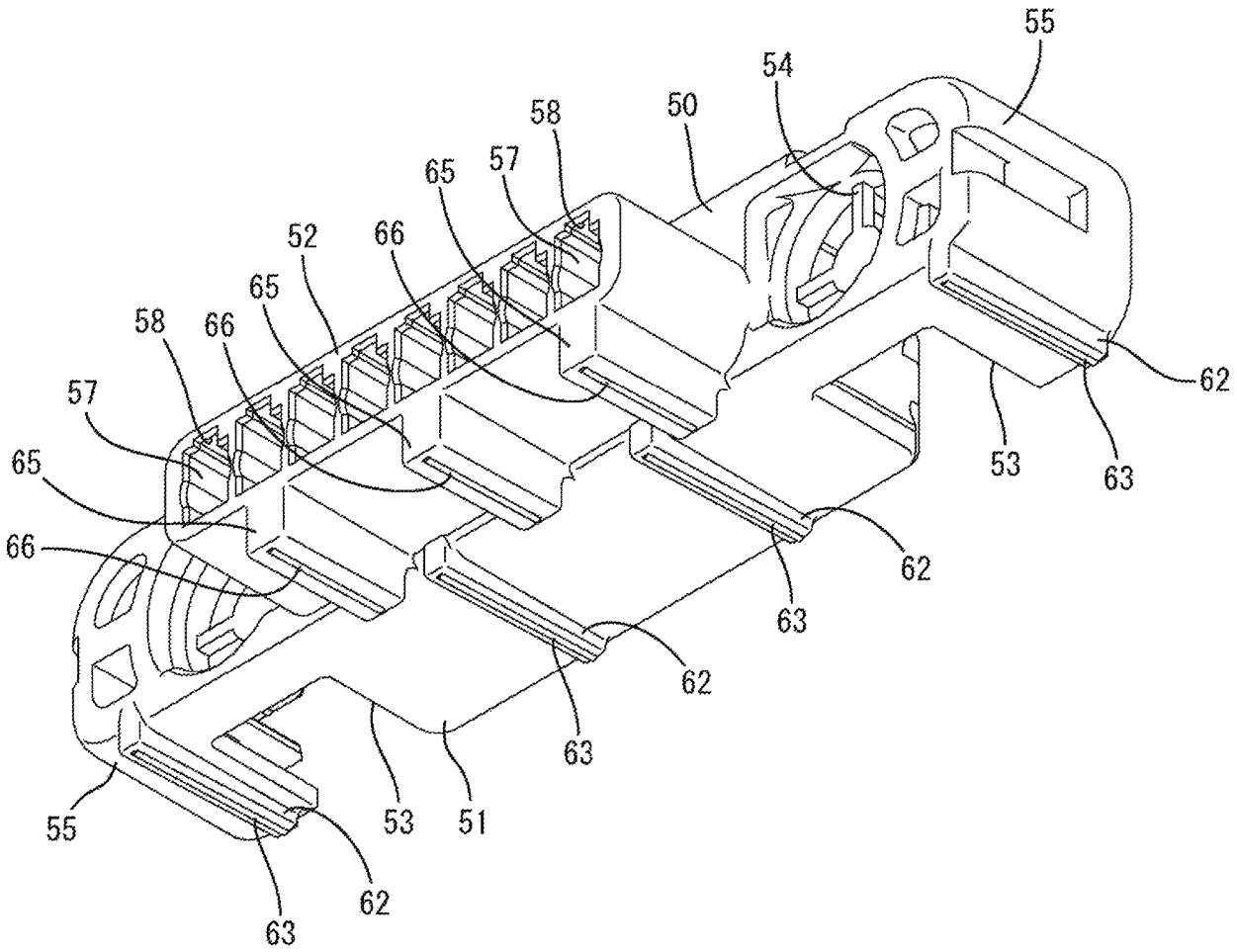
FIG. 8 is a perspective view of the rear holder viewed obliquely from a lower rear side.
Figure 11:
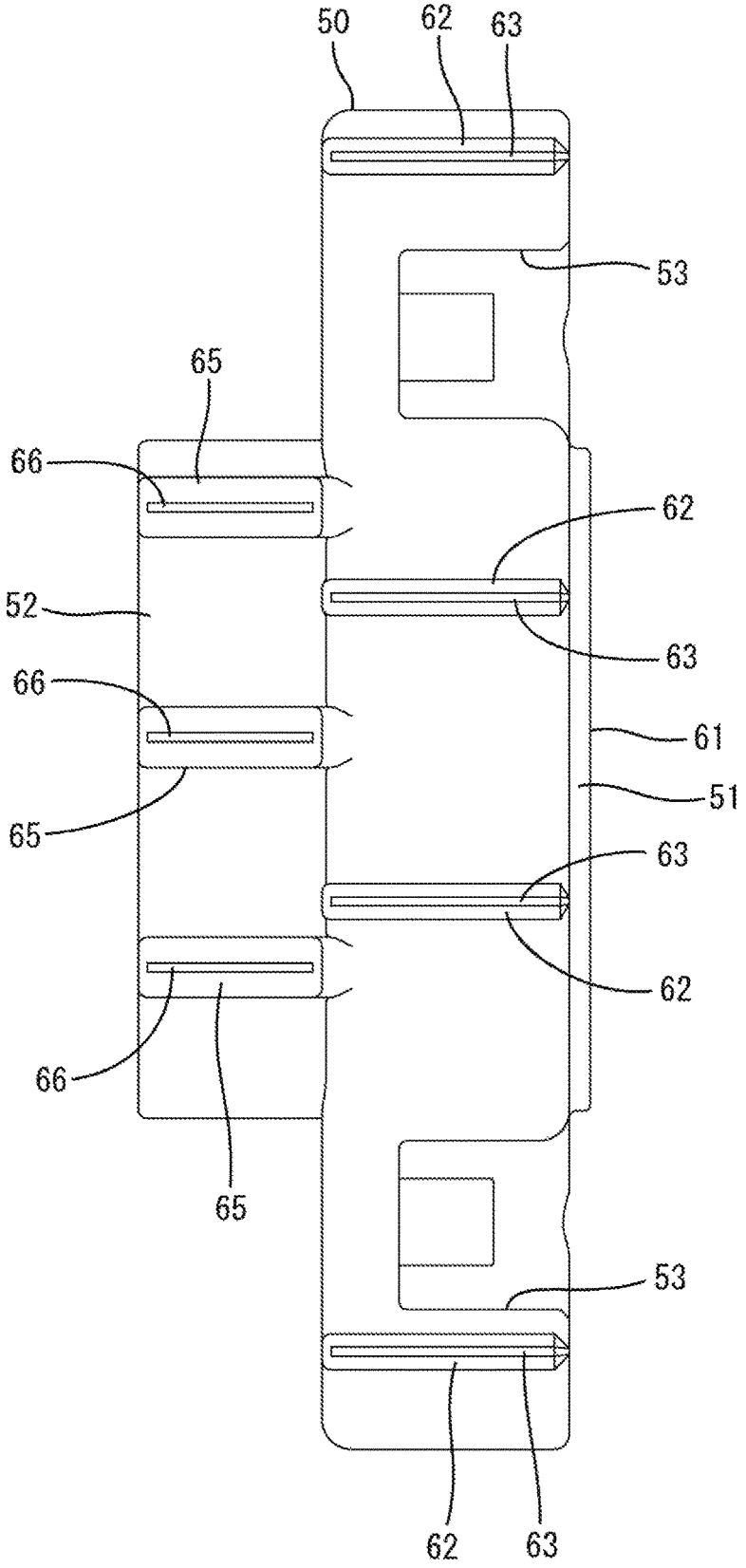
FIG. 11 is a bottom view of the rear holder.

As shown in FIGS. 8 and 11, a plurality of first ribs 62 project at interval in the lateral direction on the lower surface of the holder body 51. A pair of first ribs 62 are arranged laterally outwardly of the fitting portions 53 on both left and right end parts of the lower surface of the holder body 51 and a pair of first ribs 62 are arranged at positions corresponding to the respective through holes 57 near a lateral center of the lower surface of the holder body 51. However, no first rib 62 is provided at a laterally central position of the lower surface of the holder body 51.

Figure 3:
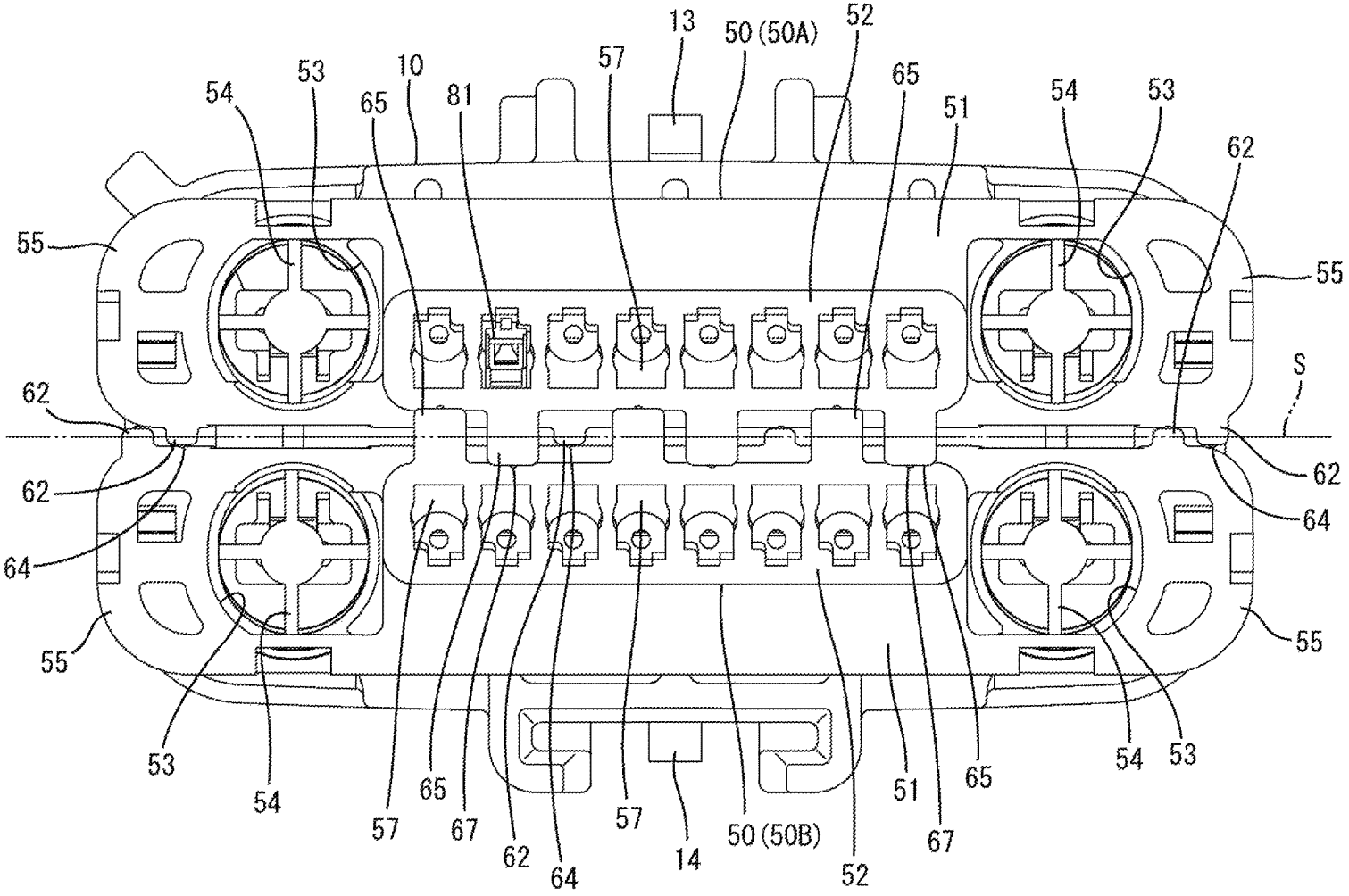
FIG. 3 is a back view of the waterproof connector.
Figure 9:
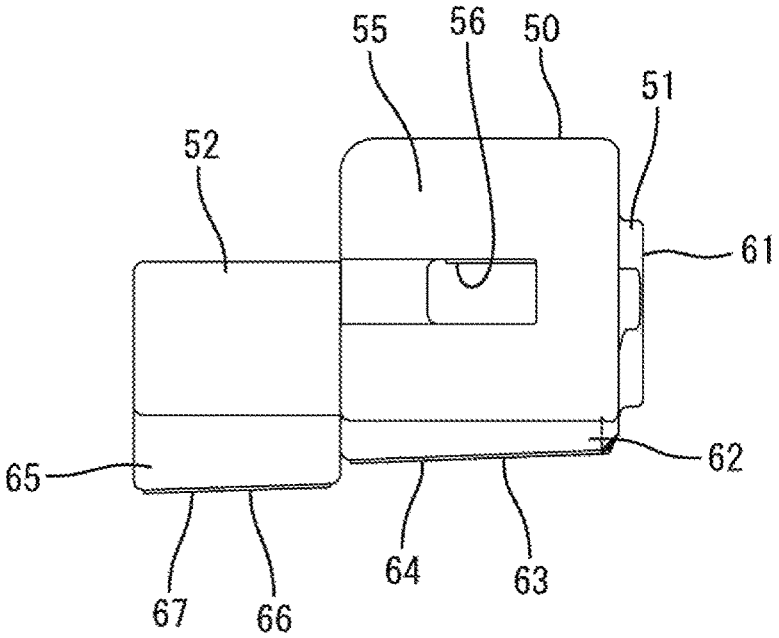
FIG. 9 is a side view of the rear holder.
Figure 10:
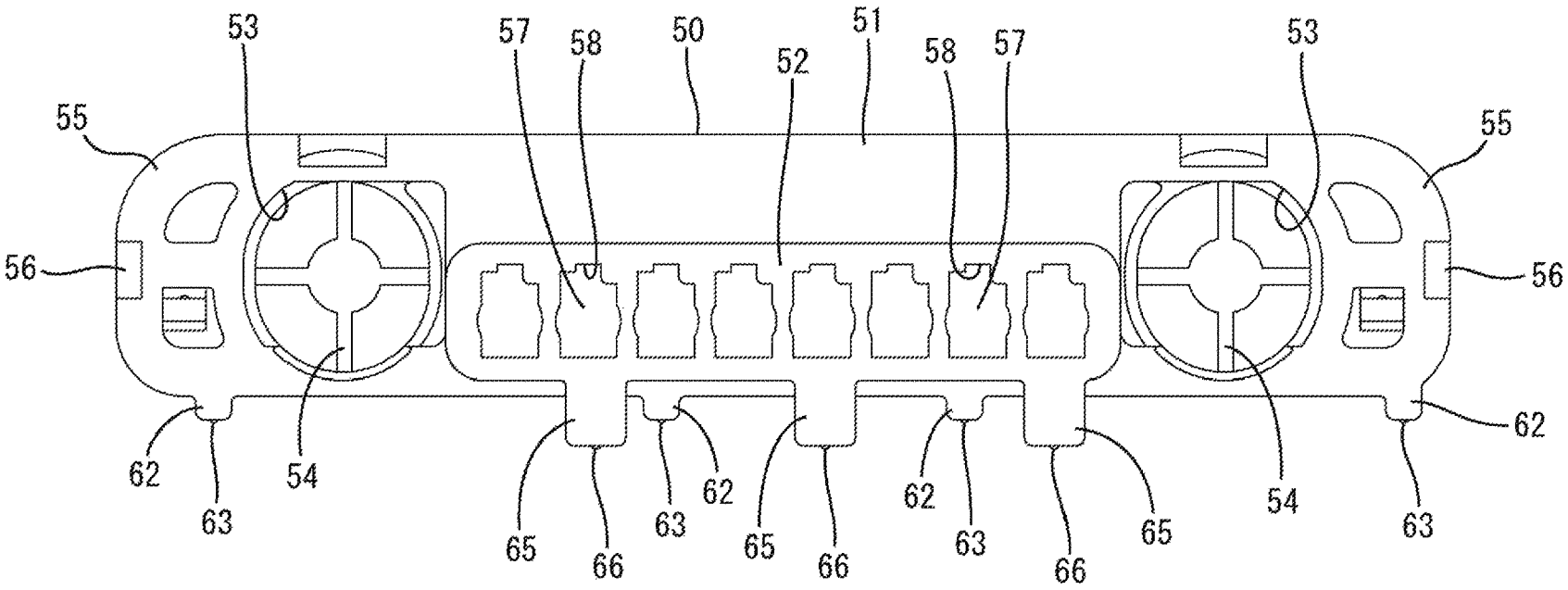
FIG. 10 is a back view of the rear holder.

As shown in FIG. 9, each first rib 62 extends in the front-rear direction over the entire length of the holder body 51 and is formed to gradually increase a downward projecting amount. As shown in FIG. 10, each first rib 62 includes a first ridge 63 in the form of a small projection extending in the front-rear direction in a laterally central part of the lower surface of a body part thereof. The projecting end surface of the first ridge 63 is gently inclined downwardly toward the rear with respect to the lower surface of the holder body 51 together with the body part and, as shown in FIG. 3, serves as a first contact surface 64 capable of coming into contact with the upper surface of the holder body 51 in the lower rear holder 50B.

As shown in FIGS. 8 and 11, a plurality of second ribs 65 project at equal intervals, in the lateral direction on the lower surface of the projecting portion 52. No second rib 65 is provided at a laterally central position of the lower surface of the projecting portion 52.

The respective second ribs 65 are shifted in the lateral direction from the respective first ribs 62. Each second rib 65 extends in the front-rear direction over the entire length of the projecting portion 52 and is formed to gradually increase a downward projecting amount. The rear ends of the respective second ribs 65 are coupled to the rear surface of the holder body 51. The projecting amount of the second ribs 65 is larger than that of the first ribs 62, and a thickness of the second ribs 65 in the lateral direction is larger than that of the first ribs 62 in the lateral direction. In short, the second ribs 65 are one size larger than the first ribs 62.

Each second rib 65 includes a second ridge 66 extending in the front-rear direction in a laterally central part of the lower surface of a body part thereof. The projecting end surface of the second ridge 66 is gently inclined downwardly toward the rear with respect to the lower surface of the projecting portion 52 together with the body part and, as shown in FIG. 3, serves as a second contact surface 67 capable of coming into contact with the upper surface of the projecting portion 52 in the lower rear holder 50B. As shown in FIG. 9, the second contact surface 67 is located below the first contact surface 64. Further, an angle of inclination of the second contact surface 67 is substantially equal to that of the first contact surface 64.

Next, an assembling method and functions of the waterproof connector of the first embodiment are described.

In assembling, the seal members 40 are first inserted into the accommodating portions 21, 22 of the housing body 11 from behind as shown in FIG. 4. The entire seal members 40 are fit and accommodated into the accommodating portions 21, 22. Subsequently, as shown in FIG. 3, the rear holders 50 are mounted on the housing body 11 from behind. When the rear holders 50 are mounted on the connector housing 10 by the locking action of the lock portions 55, the detachment restricting surfaces 61 of the holder bodies 51 face the rear surfaces of the seal members 40, thereby restricting rearward detachment of the seal members 40.

As shown in FIG. 1, the upper rear holder 50A is arranged to correspond to the upper accommodating portion 21 and the lower rear holder 50B is arranged to correspond to the lower accommodating portion 22, whereby the respective upper and lower rear holders 50A, 50B butt against each other via the first and second ribs 62, 65 and the axial center directions of the rear holders 50 are oriented in directions intersecting with the axial center direction of the connector housing 10 and mounting postures of the rear holders 50 on the connector housing 10 are inclined with respect to the front-rear direction (axial center direction of the connector housing 10, see chain double-dashed line indicated by D in FIGS. 1 and 2).

Specifically, the first contact surface 64 of each first rib 62 on the upper rear holder 50A comes into contact with the upper surface of the holder body 51 in the lower rear holder 50B along the front-rear direction, the second contact surface 67 of each second rib 65 on the upper rear holder 50A comes into contact with the upper surface of the projecting portion 52 in the lower rear holder 50B along the front-rear direction, the first contact surface 64 of each first rib 62 on the lower rear holder 50B comes into contact with the lower surface of the holder body 51 in the upper rear holder 50A along the front-rear direction, and the second contact surface 67 of each second rib 65 on the lower rear holder 50B comes into contact with the lower surface of the projecting portion 52 in the upper rear holder 50A along the front-rear direction. In this way, the axial center direction of the upper rear holder 50A is inclined downwardly toward the front with respect to the front-rear direction, and the axial center direction of the lower rear holder 50B is inclined upwardly toward the front with respect to the front-rear direction. As a whole, the axial center directions of the respective upper and lower rear holders 50A, 50B are inclined outwardly toward the rear with respect to the height direction.

The guiding surface 59 of each through hole 57 is arranged obliquely with respect to the front-rear direction, which is a penetrating direction through the cavity 15 and the seal hole 41, to correspond to the inclined posture of the rear holder 50 described above, and oriented toward the central side of the seal hole 41 toward the front.

Subsequently, as shown in FIG. 1, the terminal fitting 80 with the wire 90 is inserted into the through hole 57 of the rear holder 50 from behind. Circumferential rattling of the terminal fitting 80 is substantially suppressed by inserting the box portion 81 into the through hole 57. Further, the inserting posture of the terminal fitting 80 is specified by fitting the stabilizer 86 into the recess 58. Specifically, the inserting posture of the terminal fitting 80 into the through hole 57 of the upper rear holder 50A is so specified that the tab 83 is located above an axial center of the box portion 81, and the inserting posture of the terminal fitting 80 into the through hole 57 of the lower rear holder 50B is so specified that the tab 83 is located below an axial center of the box portion 81. Thus, when the inserting operation of the terminal fitting 80 proceeds, the box portion 81 slides along the guiding surface 59 between the two sides 60 of the through hole 57 and the tip of the tab 83 is displaced toward the central side of the seal hole 41.

When the inserting operation of the terminal fitting 80 proceeds and the tip of the tab 83 is inserted into the seal hole 41, the tip of the tab 83 enters between the inner peripheral lips 42 located on the central side of the seal hole 41 without coming into contact with the inclined slope 43 of the seal hole 41 or by sliding on the slope 43. Thus, the tip of the tab 83 does not break through the slope 43 of the seal hole 41 and the tab 83 can be smoothly inserted into the seal hole 41.

Thereafter, when the tip of the tab 83 passes through the seal hole 41 and the cavity 15 and reaches a position to project into the receptacle, the box portion 81 is resiliently locked by the locking lance 17 and the terminal fitting 80 is retained and held in the cavity 15. At this time, the wire 90 connected to the terminal fitting 80 is inserted into the seal hole 41 and the respective inner peripheral lips 42 of the seal hole 41 are resiliently held in close contact with the outer peripheral surface of the wire 90, thereby providing sealing around the wire 90.

As described above, according to the first embodiment, the tip of the tab 83 can be smoothly inserted into the seal hole 41 by inserting the terminal fitting 80 into the through hole 57 along the guiding surface 59. In this case, since the guiding surface 59 is provided in a range extending over the entire length of the through hole 57 in the front-rear direction, the terminal fitting 80 is guided into the seal hole 41 with good reliability. As a result, a situation where the seal member 40 is damaged due to interference with the tab 83 can be avoided and predetermined waterproofness of the seal member 40 can be reliably ensured.

Further, since the guiding surface 59 constitutes the two sides 60 parallel to each other in the lengthwise cross-sectional shape of the through hole 57, the terminal fitting 80 can be arranged between the two sides 60 with rattling suppressed to be small and the accuracy of a guiding operation of the guiding surface 59 can be enhanced unlike in the case where the rear end opening of the through hole 57 is largely widened.

Further, the axial center of the rear holder 50 is disposed obliquely in the direction intersecting with the front-rear direction with respect to the connector housing 10, whereby the guiding surfaces 59 are obliquely arranged. Thus, in molding the guiding surfaces 59, the guiding surfaces 59 need not be inclined with respect to the axial center direction of the rear holder 50 and the manufacturing of the rear holder 50 can be facilitated.

Furthermore, the first and second ribs 62, 65 extending in the front-rear direction are provided on the outer surface of the rear holder 50 and formed to increase the projecting amount from the outer surface toward the rear, the first and second contact surfaces 64, 67 come into contact with the facing outer surface of the mating rear holder 50 along the front-rear direction, and the rear holder 50 is obliquely disposed with respect to the connector housing 10 via these ribs 62, 65. Thus, the inclined posture of the rear holder 50 can be realized only by changing the projecting amounts of the ribs 62, 65 and the structure of the rear holder 50 does not become particularly complicated. Particularly, in the case of the first embodiment, since the second ribs 65 are provided in addition to the first ribs 62, a situation where the laterally central part of the rear holder 50 is deformed in an arched manner is avoided and the accuracy of a guiding operation of the guiding surface 59 can be further enhanced.

Furthermore, the respective upper and lower rear holders 50A, 50B adjacent in the height direction are disposed such that the outer surfaces provided with the ribs 62, 65 face each other, the contact surfaces 64, 67 of the ribs 62, 65 provided on the outer surface of the upper rear holder 50A come into contact with the outer surface of the lower rear holder 50B along the front-rear direction, the contact surfaces 64, 67 of the ribs 62, 65 provided on the outer surface of the lower rear holder 50B come into contact with the outer surface of the upper rear holder 50A along the front-rear direction. Thus, the inclined posture of the rear holder 50 can be realized without requiring any special structure except the ribs 62, 65 and the structure can be further simplified. Particularly, since the respective rear holders 50 are identical to each other and commonly used also for the mating connector housing, an increase in the number of components can be avoided.

Figure 12:
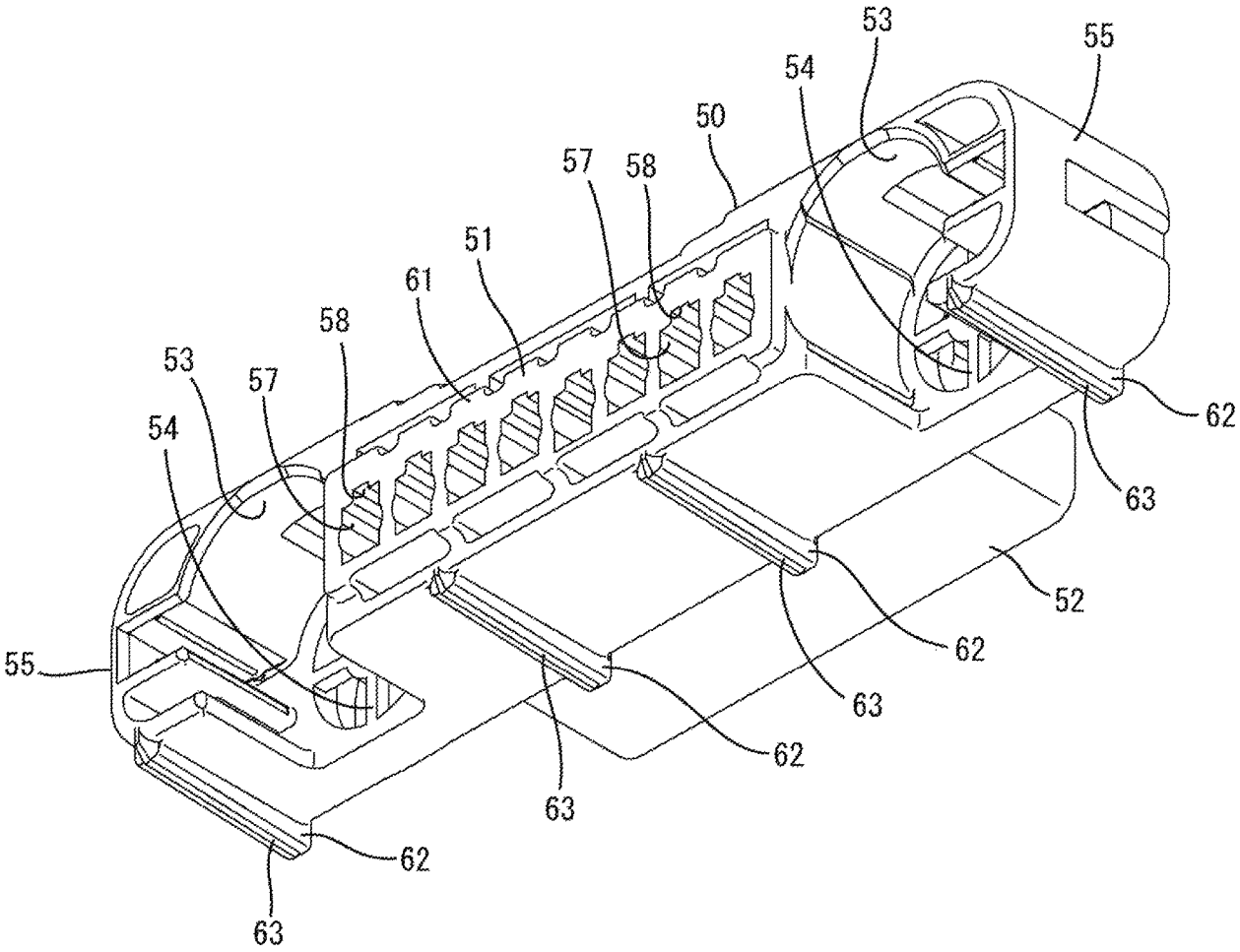
FIG. 12 is a perspective view of a rear holder viewed obliquely from a lower-front side in a waterproof connector of a second embodiment of the present invention.
Figure 13:
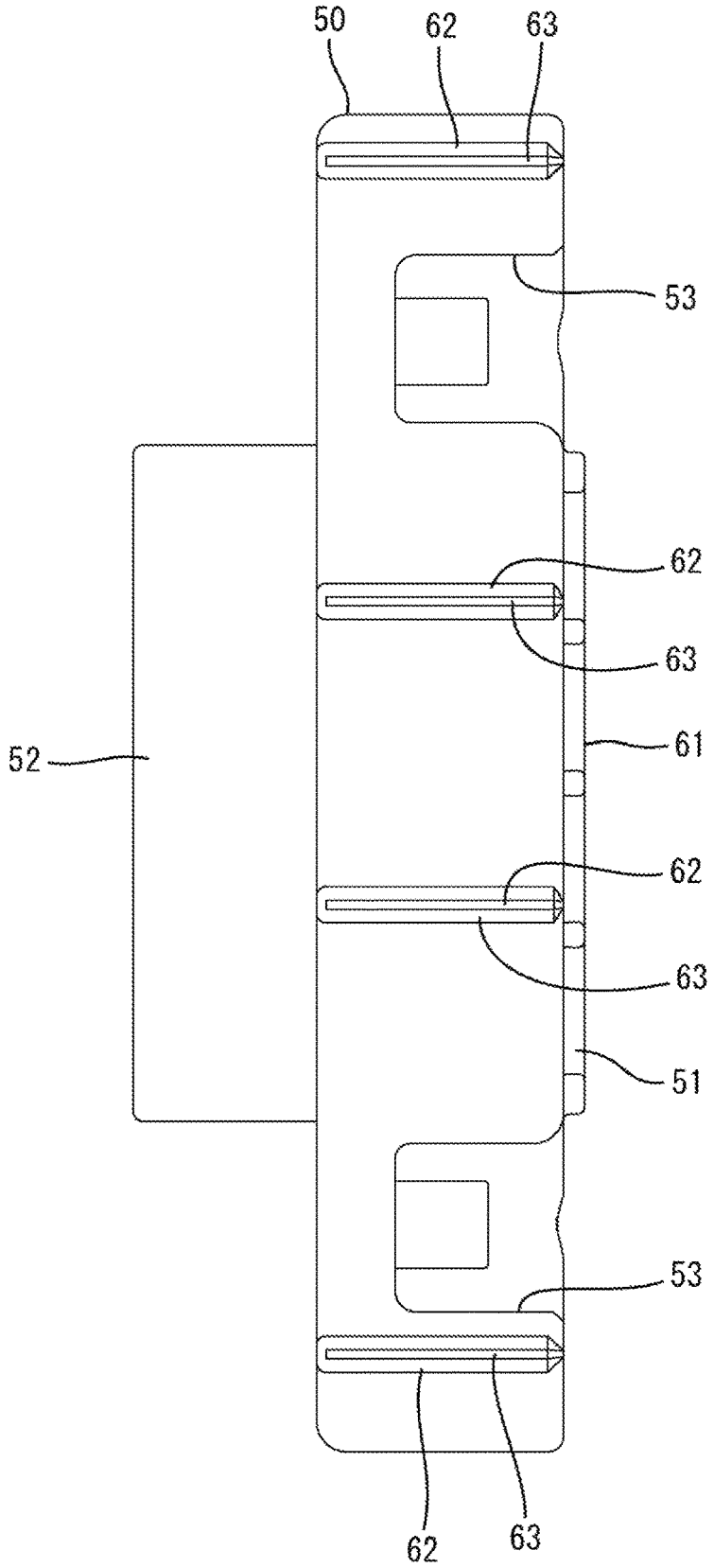
FIG. 13 is a bottom view of the rear holder of the second embodiment.

FIGS. 12 and 13 show a second embodiment of the present invention. The second embodiment differs from the first embodiment in some ribs, but the other configuration is the same as in the first embodiment. Thus, the same components are denoted by the same reference signs as in the first embodiment below.

A rear holder 50 of the second embodiment is formed by omitting the second ribs 65 from the rear holder 50 of the first embodiment. Specifically, the second ribs 65 are not provided on a projecting portion 52 and only first ribs 62 are provided on a holder body 51.

In the case of the second embodiment, although an assembled state is not shown, first contact surfaces 64 of the respective first ribs 62 on the upper rear holder 50A come into contact with the upper surface of the holder body 51 in the lower rear holder 50B along the front-rear direction and first contact surfaces 64 of the respective first ribs 62 on the lower rear holder 50B come into contact with the lower surface of the holder body 51 in the upper rear holder 50A along the front-rear direction, whereby the respective upper and lower rear holders 50A, 50B are disposed in an inclined posture on the connector housing 10 as in the first embodiment. Thus, as in the first embodiment, guiding surfaces 59 of through holes 57 are oriented toward central sides of seal holes 41 toward the front and terminal fittings 80 can be smoothly inserted into the seal holes 41 along the guiding surfaces 59. Particularly, since the second ribs 65 are omitted from the rear holders 50 in the case of the second embodiment, the structure can be further simplified.

Other embodiments of the present invention are briefly described.

The rear holder may be mounted in an inclined state on the connector housing by causing the contact surfaces of the ribs to come into contact with a part different from the rear holder along the front-rear direction. The part different from the rear holder may be, for example, a projecting piece projecting from the rear surface of the connector housing.

The rear holder may be mounted in an inclined state on the connector housing by being fit to a receiving structure of the connector housing without via the ribs.

Cavities may be provided in three or more stages arranged one above another in the connector housing and three or more seal members and rear holders may be provided to correspond to three or more stages of the cavities.

The use of a female terminal fitting having no tab as the terminal fitting is not denied.

LIST OF REFERENCE SIGNS

10 . . . connector housing
15 . . . cavity
40 . . . seal
41 . . . seal hole
50 . . . rear holder
57 . . . through hole
59 . . . guiding surface
60 . . . two sides
62 . . . first rib (rib)
65 . . . second rib (rib)
80 . . . terminal fitting

81 . . . box portion
83 . . . tab
90 . . . wire

What is claimed is:

1. A waterproof connector, comprising:

a connector housing having opposite front and rear ends and including a cavity extending through the connector housing in a front-rear direction;

a seal member disposed in a rear part of the connector housing and including a seal hole communicating with the cavity in the front-rear direction; and a rear holder disposed on the rear end of the connector housing to restrict rearward detachment of the seal member and including opposite front and rear ends, a through hole extending through the rear holder from the rear end of the rear holder to the front end thereof and communicating with the seal hole in the front-rear direction, wherein:

a terminal fitting is inserted sequentially through the through hole and the seal hole and into the cavity, and a wire is connected to the terminal fitting; and the through hole is provided with a guiding surface inclined toward the front end of the rear holder and toward a central side of the seal hole so that the guiding surface is inclined to the front-rear direction in a range extending over substantially an entire length of the through hole in the front-rear direction with the rear holder disposed on the connector housing.

2. The waterproof connector of claim 1, wherein the guiding surface constitutes two sides parallel to each other in a lengthwise cross-sectional shape of the through hole.

3. The waterproof connector of claim 2, wherein the guiding surface is obliquely arranged by disposing an axial center of the rear holder obliquely in a direction intersecting with the front-rear direction with respect to the connector housing.

4. The waterproof connector of claim 3, wherein a rib extending in the front-rear direction is provided on an outer surface of the rear holder and formed to increase a projecting amount from the outer surface of the rear holder toward the rear end, a projecting end surface of the rib comes into contact with a facing part along the front-rear direction, whereby the rear holder is disposed in an inclined state on the connector housing.

5. The waterproof connector of claim 4, wherein a plurality of the rear holders are disposed on the connector housing, the rear holders adjacent to each other are disposed such that the outer surfaces provided with the ribs face each other, the projecting end surface of the rib provided on the outer surface of one of the rear holders comes into contact with the outer surface of the other rear holder along the front-rear direction, and the projecting end surface of the rib provided on the outer surface of the other rear holder comes into contact with the outer surface of the one rear holder along the front-rear direction.

6. A waterproof connector, comprising:

a connector housing having opposite front and rear ends and a cavity extending through the connector housing from the rear end to the front end in a front-rear direction;

a seal member disposed in a rear part of the connector housing and including a seal hole communicating with the cavity in the front-rear direction; and a rear holder disposed on the rear end of the connector housing to restrict rearward detachment of the seal member and including a through hole extending through the rear holder from a rear end of the rear holder to a front end thereof, the front end of the through hole communicating with the seal hole in the front-rear direction, a rib extending in the front-rear direction on an outer surface of the rear holder and formed to increase a projecting amount from the outer surface of the rear holder toward the rear end of the rear holder, a projecting end surface of the rib comes into contact with a facing part along the front-rear direction, so that an axial center of the rear holder is disposed obliquely in an inclined state on the connector housing and intersecting the front-rear direction, the through hole being having a guiding surface inclined toward a center of the seal hole with respect to the front-rear direction along a range extending over substantially an entire length of the through hole from the rear end of the rear holder to the front end thereof in the front-rear direction, wherein a terminal fitting is guided by the guiding surface of the through hole, through the seal hole and into the cavity.

7. The waterproof connector of claim 6, wherein a plurality of the rear holders are disposed on the connector housing, the rear holders adjacent to each other are disposed such that the outer surfaces provided with the ribs face each other, the projecting end surface of the rib provided on the outer surface of one of the rear holders comes into contact with the outer surface of the other rear holder along the front-rear direction, and the projecting end surface of the rib provided on the outer surface of the other rear holder comes into contact with the outer surface of the one rear holder along the front-rear direction.

* * * * *